US009848637B2

(12) United States Patent
Haddad

(10) Patent No.: US 9,848,637 B2
(45) Date of Patent: Dec. 26, 2017

(54) SMOKING ASSEMBLY

(71) Applicant: Ramon Haddad, Old Bridge, NJ (US)

(72) Inventor: Ramon Haddad, Old Bridge, NJ (US)

( * ) Notice: Subject to any disclaimer, the term of this patent is extended or adjusted under 35 U.S.C. 154(b) by 321 days.

(21) Appl. No.: 14/627,308

(22) Filed: Feb. 20, 2015

(65) Prior Publication Data

US 2016/0242460 A1 Aug. 25, 2016

(51) Int. Cl.
*A24F 1/00* (2006.01)
*A24F 1/32* (2006.01)

(52) U.S. Cl.
CPC . *A24F 1/00* (2013.01); *A24F 1/32* (2013.01)

(58) Field of Classification Search
CPC ..... A24F 7/00; A24F 7/02; A24F 7/04; A24F 13/02; A24F 13/04; A24F 13/06; A24F 13/08; A24F 13/10; A24F 13/12; A24F 13/22
USPC ..... 131/175, 187; D27/183
See application file for complete search history.

(56) References Cited

U.S. PATENT DOCUMENTS 598,350 A * 2/1898 Seidenspiner ..... A24F 13/14 131/175
1,816,139 A * 7/1931 Aster ..... A24F 13/30 131/179
3,406,693 A 10/1968 Jeannin
3,675,661 A 7/1972 Weaver
5,497,791 A * 3/1996 Bowen ..... A24F 13/00 131/175
5,875,784 A 3/1999 Allison
6,698,435 B2 3/2004 Miller
8,037,888 B2 10/2011 Larios
8,074,663 B2 12/2011 Ning
2013/0167852 A1* 7/2013 McDonald ..... A24F 1/00 131/328
2014/0048085 A1* 2/2014 Cox ..... A24F 13/06 131/187
2015/0264976 A1* 9/2015 Benson ..... A24F 9/12 131/244

* cited by examiner

*Primary Examiner* — Eric Yaary

(57) ABSTRACT

A smoking assembly includes a pipe that has an elongated section and an elbow section. The elbow section forms an angle with respect to the elongated section. Each of the elongated section and the elbow section is substantially hollow to have air drawn therethrough. The pipe is comprised of a rigid material. The rigid material is copper. A plurality of inserts is each removably positionable within the elbow section to retain a smoking article within the elbow section. The smoking article extends upwardly from the elbow section. Each of the plurality of inserts has a unique size with respect to each other to retain smoking articles of various sizes. A cap is removably coupled to the elbow section to retain the insert within the elbow section. A lid is positionable over the smoking article to extinguish the smoking article.

7 Claims, 5 Drawing Sheets

SMOKING ASSEMBLY

BACKGROUND OF THE DISCLOSURE

Field of the Disclosure

The disclosure relates to smoking devices and more particularly pertains to a new smoking device for holding a smoking article in an upright position.

SUMMARY OF THE DISCLOSURE

An embodiment of the disclosure meets the needs presented above by generally comprising a pipe that has an elongated section and an elbow section. The elbow section forms an angle with respect to the elongated section. Each of the elongated section and the elbow section is substantially hollow to have air drawn therethrough. The pipe is comprised of a rigid material. The rigid material is copper. A plurality of inserts is each removably positionable within the elbow section to retain a smoking article within the elbow section. The smoking article extends upwardly from the elbow section. Each of the plurality of inserts has a unique size with respect to each other to retain smoking articles of various sizes. A cap is removably coupled to the elbow section to retain the insert within the elbow section. A lid is positionable over the smoking article to extinguish the smoking article.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
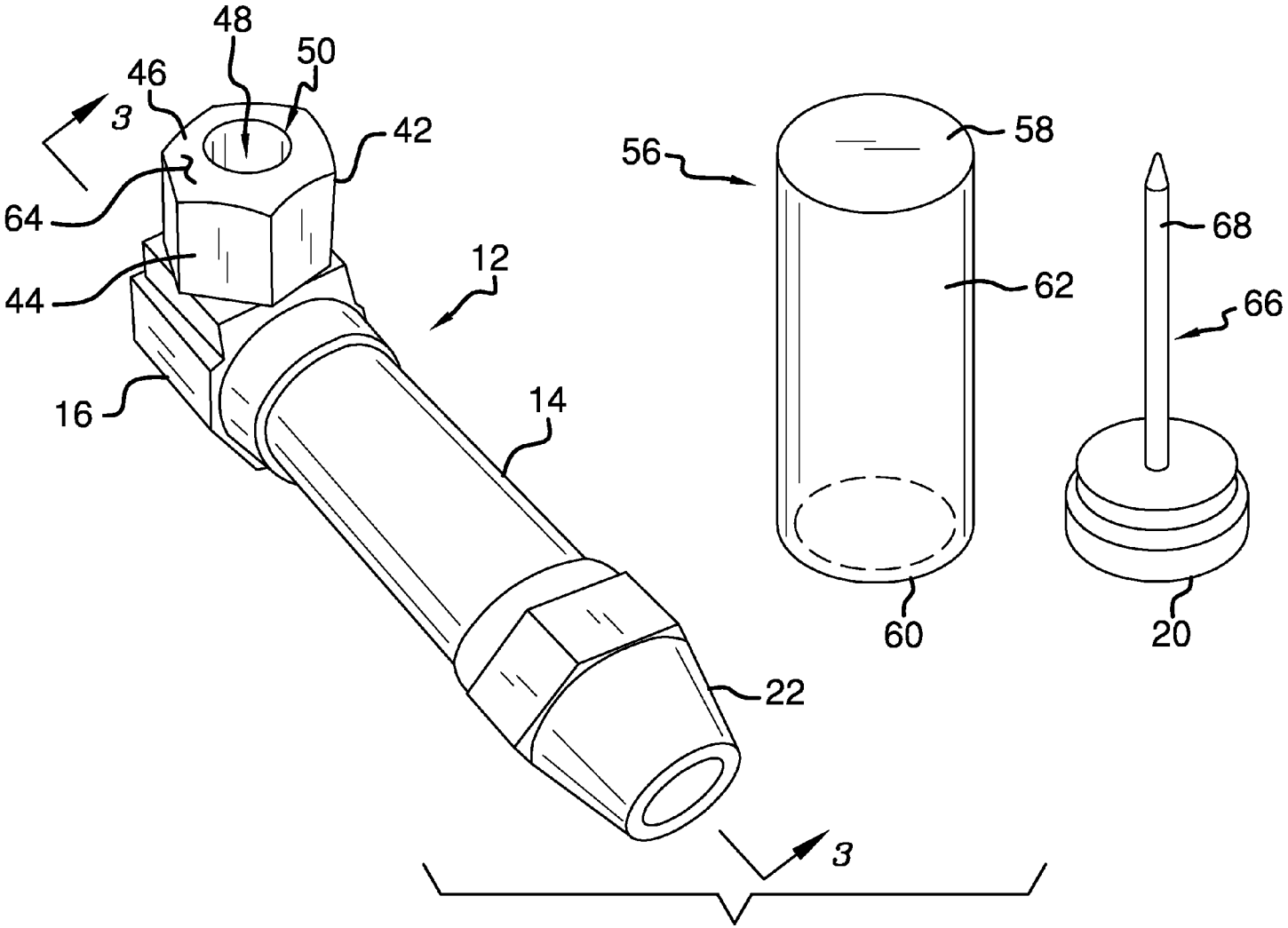
FIG. 1 is a perspective view of a smoking assembly according to an embodiment of the disclosure.
Figure 2:
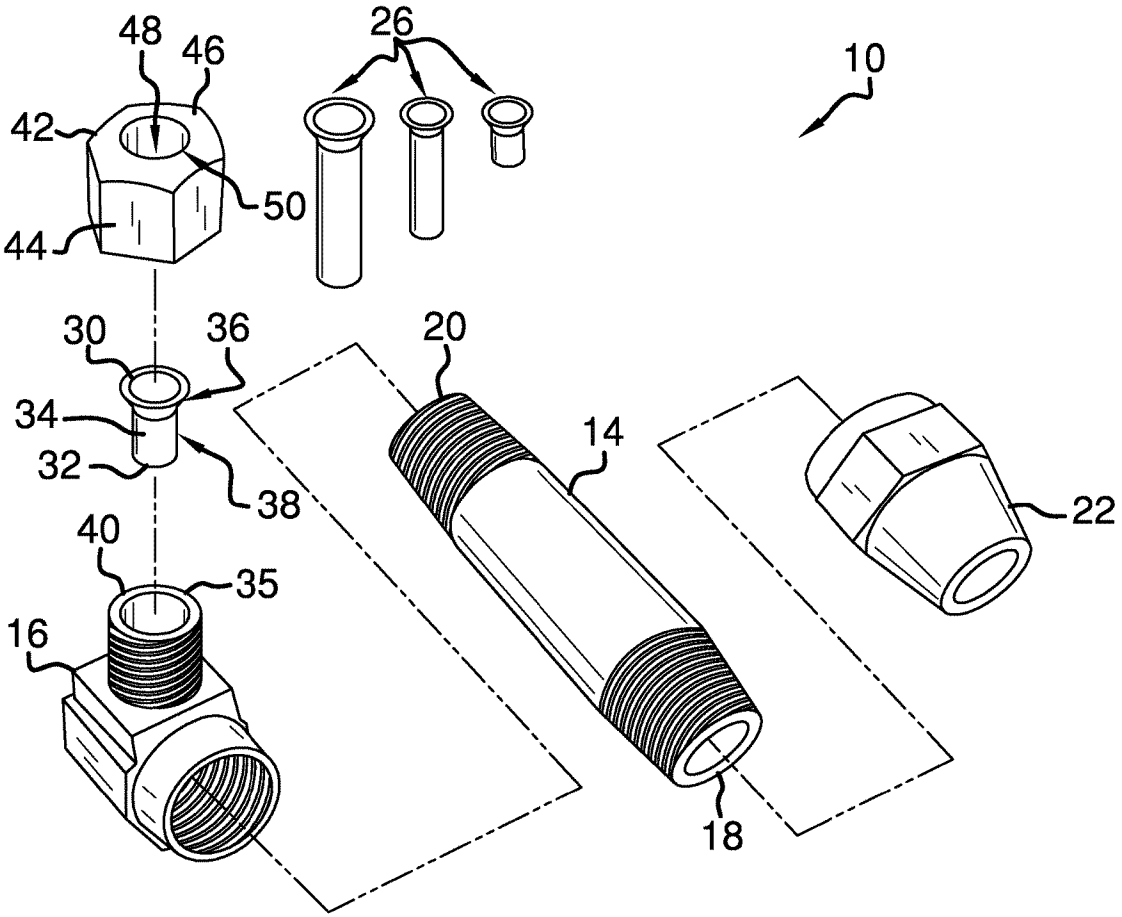
FIG. 2 is an exploded perspective view of an embodiment of the disclosure.
Figure 3:
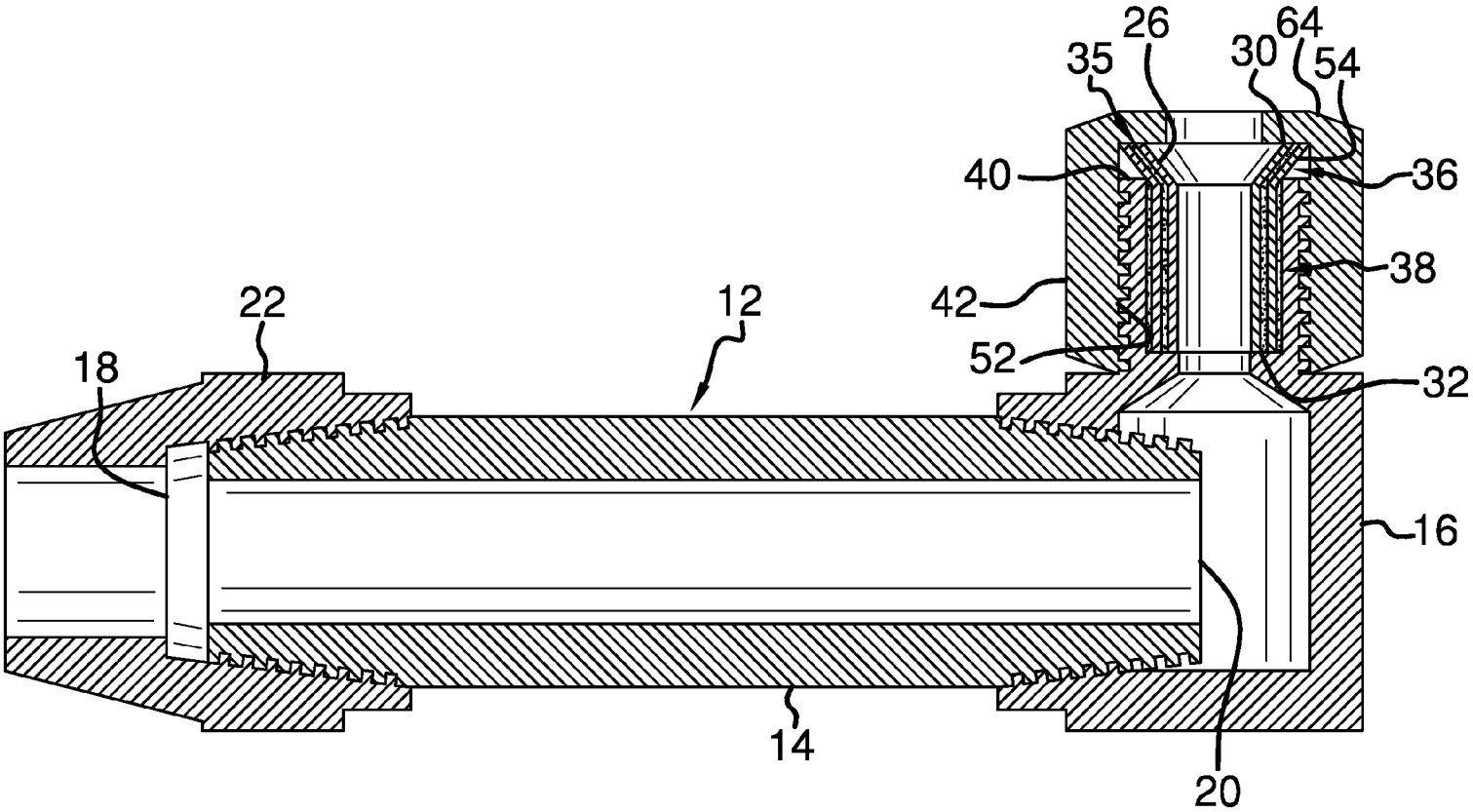
FIG. 3 is a cross sectional view taken along line 3-3 of FIG. 1 of an embodiment of the disclosure.
Figure 4:
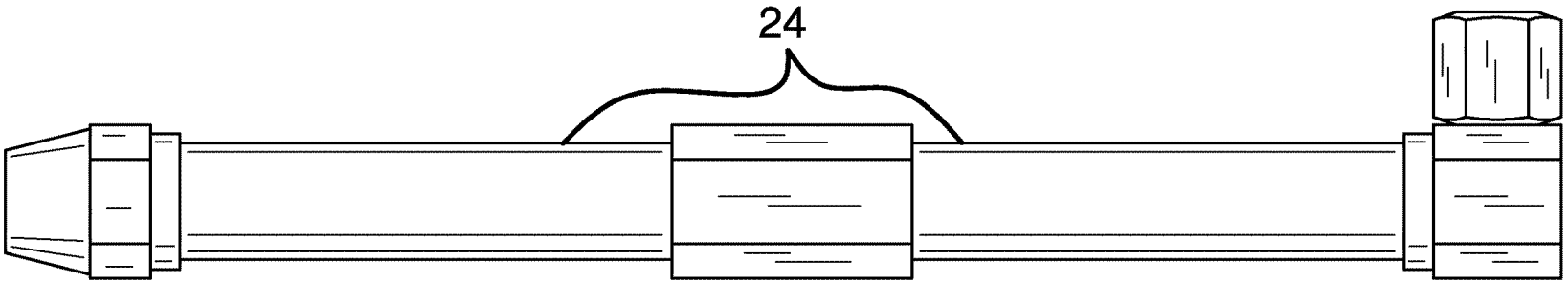
FIG. 4 is a right side view of an embodiment of the disclosure.
Figure 5:
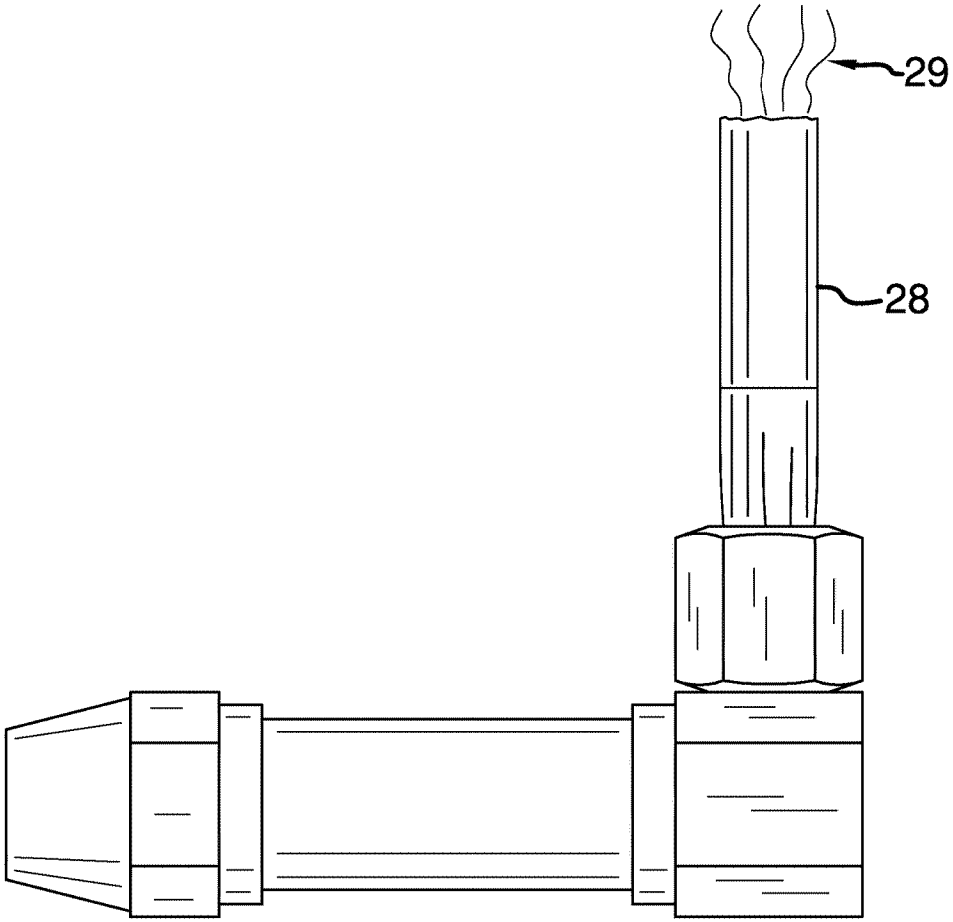
FIG. 5 is an in-use view of an embodiment of the disclosure.

With reference now to the drawings, and in particular to FIGS. 1 through 5 thereof, a new smoking device embodying the principles and concepts of an embodiment of the disclosure and generally designated by the reference numeral 10 will be described.

As best illustrated in FIGS. 1 through 5, the smoking assembly 10 generally comprises a pipe 12 that has an elongated section 14 and an elbow section 16. The elbow section 16 forms an angle with respect to the elongated section 14. The angle may be a right angle. Each of the elongated section 14 and the elbow section 16 is substantially hollow to have air drawn therethrough. The pipe 12 is comprised of a rigid material. The rigid material is copper.

The elongated section 14 has a first end 18 and a second end 20. The elbow section 16 is removably coupled to the second end 20. A mouthpiece 22 is removably coupled to the first end 18. The mouthpiece 22 is substantially hollow. The elongated section 14 may be one of a pair of elongated sections 24 each coupled together thereby increasing a length of the pipe 12.

A plurality of inserts 26 is each removably positionable within the elbow section 16 to retain a smoking article 28 within the elbow section 16. The smoking article 28 extends upwardly from the elbow section 16, allowing smoke 29 from the smoking article 28 to be directed away from a user. The smoking article 28 may be a cigarette or a cigar of any conventional design. Each of the plurality of inserts 26 has a unique size with respect to each other to retain smoking articles 28 of various sizes.

Each of the inserts 26 has a top end 30, a bottom end 32 and a perimeter wall 34 extending between the top 30 and bottom 32 ends. Each of the inserts 26 is substantially hollow. Each of the top 30 and bottom 32 ends is open. The perimeter wall 34 has a flared section 36 and a cylindrical section 38.

The flared section 36 flares outward adjacent to the top end 30. Thus, the top end 30 has a diameter that is greater than the bottom end 32. The elbow section 16 has an open end 35. The cylindrical section 38 of a selected one of the inserts 26 is insertable into the open end 35 such that the insert 26 is oriented perpendicular to the elongated section 14. The flared section 36 abuts an edge 40 of the open end 35. The inserts 26 are nestable to accommodate a selected size of the smoking article 28.

A cap 42 is removably coupled to the elbow section 16 to retain the insert 26 within the elbow section 16. The cap 42 has a skirt 44 coupled to and extending downwardly from an upper wall 46 of the cap 42, defining an insert well 48 within the cap 42. The upper wall 46 has an aperture 50 extending therethrough such that the aperture 50 intersects the insert well 48.

The skirt 44 has an inside surface 52. The inside surface 52 is threaded. The inside surface 52 threadably engages the elbow section 16. A bottom surface 54 of the upper wall 46 abuts the top end 30 of the insert 26 such that the cap 42 retains the insert 26 within the elbow section 16. The aperture 50 in the upper wall 46 insertably receives the smoking article 28 such that the smoking article 28 extends downwardly into the insert 26.

A lid 56 is positionable over the smoking article 28 to extinguish the smoking article 28. The lid 56 has a topmost end 58, a bottommost end 60 and an exterior wall 62 extending between the topmost 58 and the bottommost 60 ends. The lid 56 is substantially hollow. The topmost end 58 is closed and the bottommost end 60 is open. The bottommost end 60 abuts a top surface 64 of the upper wall 46 of the cap 42 to cover the smoking article 28.

A poker 66 is provided. The poker 66 includes a rod 68 coupled to and extending away from a knob 70. The rod 68 may be inserted into the pipe 12 in order to clean the pipe 12. The poker 66 may be stored within the lid 56. The knob 70 engages the bottommost end 60 when the poker 66 is positioned within the lid 56 thereby closing the bottommost end 60.

In use, the smoking article 28 is smoked while the smoking article 28 is positioned within the pipe 12. The entire smoking article 28 may be smoked at time, or the lid 56 may be placed over the smoking article 28, allowing the smoking article 28 to be finished at a later time. The assembly 10 is broken down into its constituent parts when the assembly 10 needs to be cleaned.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A smoking assembly configured to retain a smoking article in an upright position, said assembly comprising:

a pipe having an elongated section and an elbow section wherein said elbow section forms an angle with respect to said elongated section, each of said elongated section and said elbow section being substantially hollow wherein said pipe is configured to have air drawn therethrough, said pipe being comprised of a rigid material, said rigid material being copper;

a plurality of inserts each being removably positionable within said elbow section wherein said inserts are configured to retain a smoking article within said elbow section such that said smoking article extends upwardly from said elbow section, each of said plurality of inserts having a unique size with respect to each other wherein said inserts are configured to retain smoking articles of various sizes;

a cap removably coupled to said elbow section wherein said cap retains said insert within said elbow section, said cap having a skirt coupled to and extending downwardly from an upper wall of said cap to define an insert well within said cap, said upper wall having an aperture extending therethrough such that said aperture intersects said insert well, said aperture being sized relative to said inserts such that said cap is configured for retaining each said insert while the smoking article is retained by said insert; and a lid positionable over the smoking article wherein said lid is configured to extinguish the smoking article.

2. The assembly according to claim 1, wherein each of said inserts having a top end, a bottom end, and a perimeter wall extending between said top and bottom ends, each of said inserts being substantially hollow, each of said top and bottom ends being open.

3. The assembly according to claim 2, wherein said perimeter wall having a flared section and a cylindrical section, said flared section flaring outward adjacent to said top end wherein said top end has a diameter being greater than said bottom end.

4. The assembly according to claim 3, wherein:

said elbow section having an open end; and said cylindrical section of a selected one of said inserts being insertable into said open end such that said insert is oriented perpendicular to said elongated section, said flared section abutting an edge of said open end, said inserts being nestable to accommodate a selected size of the smoking article.

5. The assembly according to claim 1, wherein:

said inserts having a top end; and said skirt having an inside surface, said inside surface being threaded, said inside surface threadably engaging said elbow section having a bottom surface of said upper wall abutting said top end of said insert such that said cap retains said insert within said elbow section, said aperture in said upper wall being configured to insertably receive the smoking article such that the smoking article extends downwardly into said insert.

6. The assembly according to claim 5, wherein said lid having a topmost end, a bottommost end and an exterior wall extending between said topmost and said bottommost ends, said lid being substantially hollow, said topmost end being closed, said bottommost end being open, said bottommost end abutting a top surface of said upper wall of said cap wherein said lid is configured to cover the smoking article.

7. A smoking assembly configured to retain a smoking article in an upright position, said assembly comprising:

a pipe having an elongated section and an elbow section wherein said elbow section forms an angle with respect to said elongated section, each of said elongated section and said elbow section being substantially hollow wherein said pipe is configured to have air drawn therethrough, said pipe being comprised of a rigid material, said rigid material being copper;

a plurality of inserts each being removably positionable within said elbow section wherein said inserts are configured to retain a smoking article within said elbow section such that said smoking article extends upwardly from said elbow section, each of said plurality of inserts having a unique size with respect to each other wherein said inserts are configured to retain smoking articles of various sizes, each of said inserts having a top end, a bottom end, and a perimeter wall extending between said top and bottom ends, each of said inserts being substantially hollow, each of said top and bottom ends being open, said perimeter wall having a flared section and a cylindrical section, said flared section flaring outward adjacent to said top end wherein said top end has a diameter being greater than said bottom end, said elbow section having an open end, said cylindrical section of a selected one of said inserts being insertable into said open end such that said insert is oriented perpendicular to said elongated section, said flared section abutting an edge of said open end, said inserts being nestable to accommodate a selected size of the smoking article;

a cap removably coupled to said elbow section wherein said cap retains said insert within said elbow section, said cap having a skirt coupled to and extending downwardly from an upper wall of said cap to define an insert well within said cap, said upper wall having an aperture extending therethrough such that said aperture intersects said insert well, said skirt having an inside surface, said inside surface being threaded, said inside surface threadably engaging said elbow section having a bottom surface of said upper wall abutting said top end of said insert such that said cap retains said insert within said elbow section, said aperture being sized relative to said inserts such that said cap is configured for retaining each said insert while the smoking article is retained by said insert, said aperture in said upper wall being configured to insertably receive the smoking article such that the smoking article extends downwardly into said insert; and a lid positionable over the smoking article wherein said lid is configured to extinguish the smoking article, said lid having a topmost end, a bottommost end and an exterior wall extending between said topmost and said bottommost ends, said lid being substantially hollow, said topmost end being closed, said bottommost end being open, said bottommost end abutting a top surface of said upper wall of said cap wherein said lid is configured to cover the smoking article.

* * * * *